United States Patent [19]

Hautemont

[11] Patent Number: 4,534,494

[45] Date of Patent: Aug. 13, 1985

[54] CLEANING SYSTEM FOR FILLER

[75] Inventor: Jean-Claude H. Hautemont, Gif-sur-Yvette, France

[73] Assignee: Societe Anonyme dite: Etude de Realisation de Chaines Automatiques ERCA, Orsay, France

[21] Appl. No.: 441,976

[22] Filed: Nov. 15, 1982

[51] Int. Cl.[3] ..... B67D 1/08

[52] U.S. Cl. ..... 222/148; 222/478; 141/91; 239/112

[58] Field of Search ..... 134/104, 109, 120, 187, 134/190, 191; 137/238, 240, 241; 222/148, 1; 239/106, 112, 113, 119; 141/89, 90, 91

[56] References Cited

U.S. PATENT DOCUMENTS

| | | | |
|---|---|---|---|
| 982,141 | 1/1911 | Kellar | 239/113 |
| 2,877,700 | 3/1959 | Keller | 134/120 |
| 3,764,041 | 10/1973 | Noll | 222/132 |
| 3,898,861 | 8/1975 | McMillin | 222/148 |
| 3,964,526 | 6/1976 | Sindermann | 222/148 |
| 4,396,044 | 8/1983 | Ahlers | 222/148 |

*Primary Examiner*—H. Grant Skaggs
*Attorney, Agent, or Firm*—Charles E. Brown

[57] ABSTRACT

This relates to a wash system for cleaning fillers of a multiple filler form, fill and seal machine. Multiple fillers are provided simultaneously to fill a plurality of previously formed cups, and these fillers are arranged in clusters, for example four fillers to a cluster. There is associated with the fillers a wash solution return duct through which nozzles of the fillers pass. The fillers are located within sleeves which communicate with the duct and plug elements are provided for closing the sleeves during the wash cycle, after which a wash solution may be directed through the fillers in lieu of the normal product with the system being entirely enclosed and without there being waste of the wash solution into the interior of the apparatus.

12 Claims, 6 Drawing Figures

CLEANING SYSTEM FOR FILLER

This invention relates in general to new and useful improvements in fillers for package forming machines wherein a liquid product is placed in cups or containers in a sealed environment. The invention particularly relates to apparatus for and method of cleaning such fillers.

The apparatus to which this invention particularly relates forms from a continuous web plural cups or containers which are normally arranged in pairs longitudinally of the machine and may include twelve or more cups transversely of the machine. While each set of cups is being formed from the web, a like number of fillers simultaneously dispense into the cups previously formed the liquid product which is to be packaged. This invention particularly relates to a simple apparatus for cleaning all of the fillers simultaneously with a minimum disturbance to the apparatus.

Most particularly, in accordance with this invention, there is provided a duct which underlies portions of all of the fillers and has extending therethrough nozzles of the fillers. Each nozzle is recessed within a sleeve which has it upper end in communication with the duct and an open lower end. In the normal operation of the fillers, the cleaning system has no function and it in no way disturbs or interferes with the filling operation.

When it is desired to clean the fillers, the bottom of each sleeve is closed by a closure plug and the supply to each filler is switched from product to wash solution. The nozzles are operated in the normal manner, but in lieu of cups being filled, the wash solution is returned through the sleeves into the duct. In this manner the wash solution is retained within the enclosed return system and does not enter the remainder of the forming, filling and sealing apparatus.

In accordance with this invention, a portion of a tunnel of the apparatus is mounted for tilting movement so that the wash solution will run to one end of the duct during or after the washing operation and also so that access may be obtained generally to the filler from below.

With the above and other objects in view that will hereinafter appear, the nature of the invention will be more clearly understood by reference to the following detailed description, the appended claims, and the several views illustrated in the accompanying drawings.

In THE DRAWINGS

Figure 1:
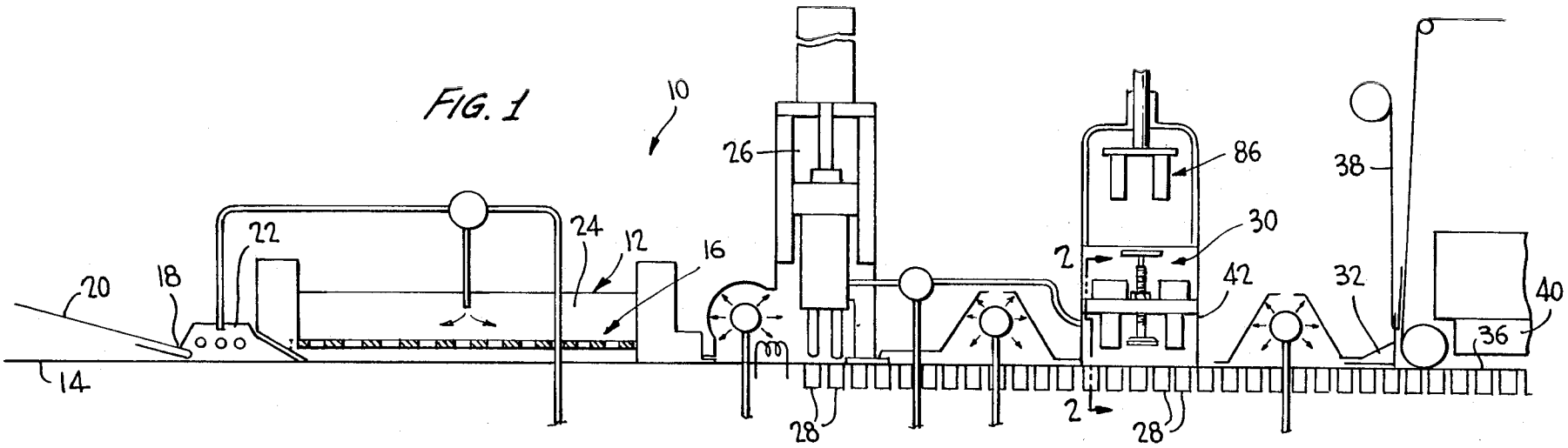
FIG. 1 is a schematic longitudinal sectional view through a form, fill and seal machine in accordance with this invention.

Referring now to the drawings in detail, it will be seen that in accordance with this invention there is provided a form, fill and seal apparatus 10 wherein there is provided a tunnel-like housing which may be formed in segments and which is generally identified by the numeral 12. A thermoformable web 14 is sealed with respect to bottoms of the sides of the housing 12 so as to form in conjunction with the housing 12 a sterile chamber 16.

The chamber 16 has a narrow entrance 18 for the thermoformable web and when the web 14 has a sterile face, it is covered by a removable cover web 20 which is peeled therefrom immediately adjacent the entrance 18, but within the sterile chamber 16.

The first part of the sterile chamber 16 may include a flash sector 22 wherein high temperature infrared heating elements are off and on operated to provide an initial heating, sterilization or bonding as may be required.

Next, the sterile chamber includes a heating box area 24 wherein the web 14 is heated to a thermoforming temperature. The heated web 14 then passes through a forming area 26 where cups or containers 28 are formed from the web 14 with the cups normally being formed two wide in the length direction of the machine and on the order of twelve in the width direction of the machine.

The web 14 with the cups 28 formed therein and depending therefrom then passes through a filler generally identified by the numeral 30 where a suitable product to be packaged is placed in the cups 28. The product placed in the cups in accordance with this invention would generally be a liquid.

In a final section 32 of the chamber a closure web 36 is applied to the upper surface of the formed web 14 to provide a cover for the cups 28. The cover web 36 may also have a sterile face surface which is maintained in sterile condition by a removable cover web 38.

The web 14 and the cover web 38 pass out of the sterile chamber 16 under a sealing apparatus 40 which bonds or otherwise seals the closure web 36 to the web 14.

This invention particularly relates to the filler 30 and the cleaning thereof.

Figure 2:
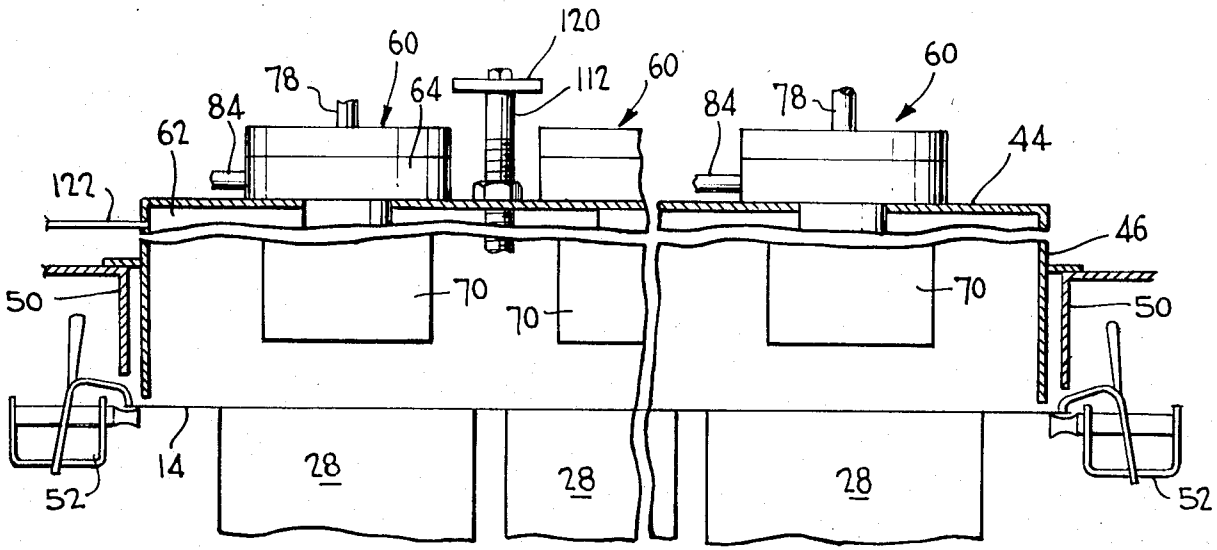
FIG. 2 is an enlarged fragmentary schematic sectional view taken generally along the line 2—2 of FIG. 1, and shows generally the details of the apparatus at the filling station.

Referring now to FIG. 2, it will be seen that the filler 30 is mounted in a separate segment 42 of the tunnel 12 and that the tunnel segment 42 includes a top wall 44 and side walls 46 with the side walls 46 having spaced above the lower edges thereof support flanges 48 which rest upon frame members 50. It will also be seen that the web 14 has the edges thereof supported by endless conveyor chain assemblies 52 so as to move the edge portions of the web 14 closely adjacent lowermost edges 54 of the sides 46. An air seal is maintained between the edge portions of the web 14 and the edges 54 by there being an overpressure of sterile air within the sterile chamber 16.

Figure 3:
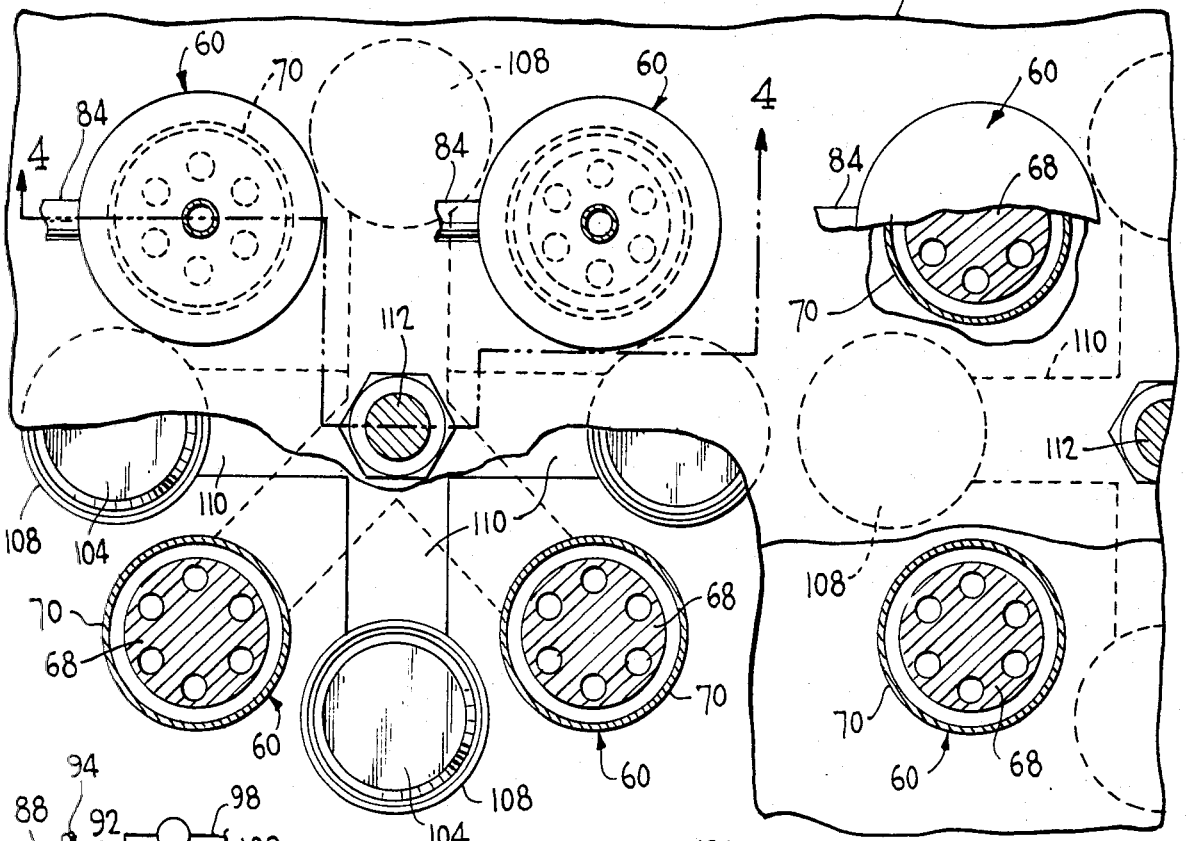
FIG. 3 is a fragmentary plan view showing the general arrangement of the fillers and the normal mounting of the closure plugs.
Figure 4:
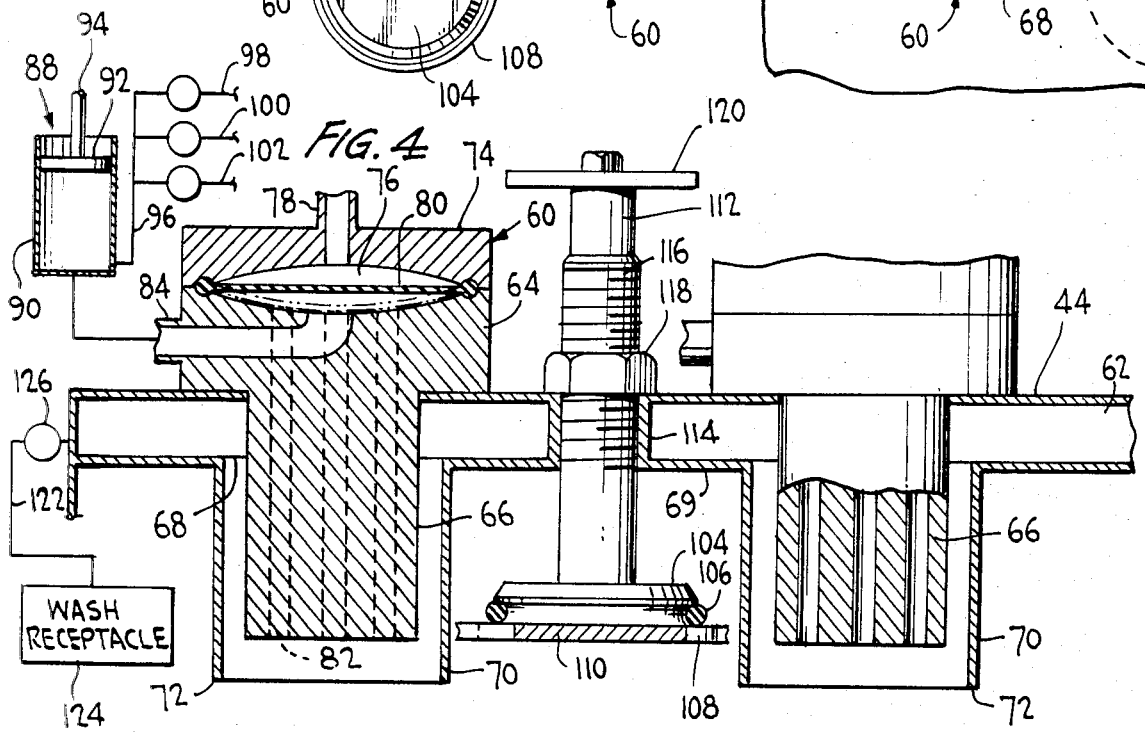
FIG. 4 is a vertical sectional view taken through one pair of fillers generally along the line 4—4 of FIG. 3, and shows the general details thereof ready for a filling cycle.
Figure 4:
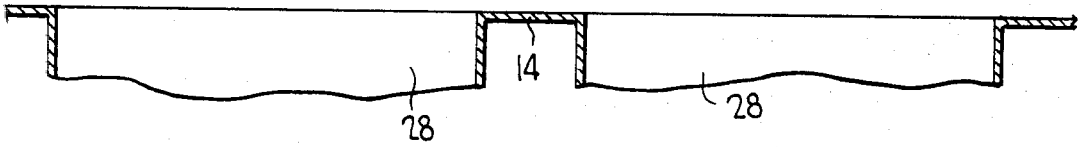
Figure 5:
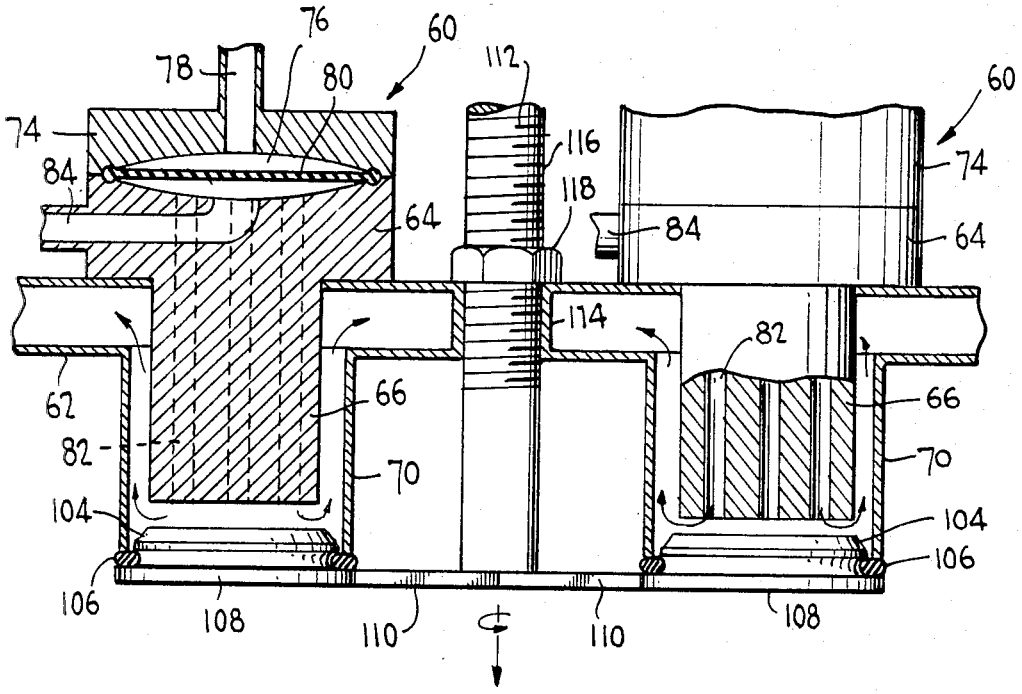
FIG. 5 is another sectional view similar to FIG. 4, but showing the system in the wash cycle.

Referring now to FIGS. 3–5 in detail, it will be seen that in accordance with the spacing and number of cups to be simultaneously filled, there is provided a plurality of fillers generally identified by the numeral 60. In the specific system in question, the fillers 60 are arranged in pairs longitudinally of the machine and may be of any practical number transversely of the machine, although only six such fillers have been illustrated. In the arrangement the fillers 60 are arranged in a cluster of four fillers, although different arrangements are feasible as will be described hereinafter.

The top wall 44 of the tunnel segment 42 forms the top wall of a hollow duct 62. The hollow duct 62 is flat and, as is clearly shown in FIG. 4, supports the fillers 60.

Each filler 60 has a control head 64 which seats in the top of the duct 62, and a lower nozzle 66 which extends through an opening in the top wall 44 of the duct 62 and is sealed with respect thereto in any desired manner. Each nozzle 66 extends through a large opening 68 in a bottom wall 69 of the duct 62 and projects below the duct 62. The lower part of each nozzle 66 is surrounded by a sleeve 70 which is secured to the lower wall 69 around the opening 68 and depends below the respective nozzle 66. Each sleeve 70 has an open lower end terminating in a lower edge 74.

Although the construction of the filler 60 may vary, it is to be noted that the head 64 has a removable cover plate 74 and has formed in the top portion thereof a diaphragm chamber 76 into which a control pressure line 78 opens. A control diaphragm 80 is located in the chamber 76.

The nozzle 66 has a plurality of passages 82 which extend entirely therethrough and which open into the lower part of the diaphragm chamber 76 below the diaphragm 80. There is also a supply passage 84 which opens into the lower part of the diaphragm chamber 76 for communication with the passages 82.

At this time it is pointed out that the fillers 60 are intended, upon each actuation thereof, to supply a preset amount of a liquid which is to be placed in the cups 28. To this end, mounted above the tunnel segment 42 is a pump mechanism generally identified by the numeral 86 in FIG. 1. The pump mechanism 86 has a separate pump unit, generally identified by the numeral 88, for each of the fillers 60, as is schematically shown in FIG. 4. Each pump unit 88 includes a cylinder 90 to which the passage 84 is connected. Each cylinder 90 carries a piston 92 which is actuated by a piston rod 94, all of the piston rods 94 being actuated in unison.

The cylinder 90 has connected thereto a supply line 96 to which there is coupled a product supply line 98, a wash liquid supply line 100 and a sterilizing fluid supply line 102. Each of these three lines is provided with its own independent shutoff valve.

During the normal operation of each filler 60 a liquid product is supplied to the pump unit 88 thereof through the product supply line 98. The diaphragm 80 is actuated in unison with the actuation of the pump unit 88 so as to provide for a complete supplying of the contents of the cylinder 90 without dribble.

When it is desired to clean the fillers 60, the product supply line 98 is closed. The bottom of each sleeve 70 is also closed. This is accomplished by inserting a tapered plug 104 into the bottom of a respective sleeve 70 with the tapered plug 104 carrying an annular gasket or sealing ring 106 positioned for engageing in sealing relation the lower edge 72 of the respective sleeve 70.

It will be seen that each of the closure plugs 104 and its associated sealing ring 106 is carried by a circular terminal arm portion 108 of one of a plurality of radiating arms 110, as is bast shown in FIG. 3. In accordance with the four nozzle cluster arrangement, there are four such arms 110, and these arms are carried by a vertical shaft 112 which extends through a sleeve 114 in an associated portion of the duct 62, the sleeve 114 extending between the walls 44, 69 of the duct.

An upper portion of each shaft 112 is externally threaded as at 116 and has threaded thereon a nut 118 which bears against the upper surface of the duct wall 44 and holds the arms 110 and the plugs 104 carried thereby in an elevated out-of-the-way position. Each shaft 112 terminates at its upper end in a handle 120 which is used to effect rotation of the shaft 112.

When it is desired to wash the fillers 60, the nut 118 is backed off on the shaft 112 so as to permit the plug members 104 to descend relative to the sleeves 70. After the plug members 104 are below the lower edges 72 of the sleeves, the shaft 120 is rotated so as to align the plug members with the sleeves 70, after which the nut 118 is rotated to lift the shaft 112 and the plugs 104 carried thereby so as to enter the plugs into the lower portions of the sleeves 70 and to engage the sealing rings 106 with the edges 72 to seal the bottoms of the sleeves 70.

Once the bottoms of the sleeves 70 have been sealed, the valve carried by the wash solution line 100 is opened to deliver a wash solution to the fillers 60 with this liquid flowing through the passages 82 in the nozzles upon the actuation of the diaphragm 80. The wash solution is sealed within the system and flows back off the sleeves 70 into the duct 62 and out through one end of the duct 62, as shown in FIG. 4, to an external line 122 which leads to a wash solution receptacle 124.

It is to be understood that the fillers 60 may be sterilized, after the wash operation has been completed, by opening the valve associated with the line 102 and directing a sterilizing fluid, preferably steam, into the supply lines 84. As long as there is condensate in the duct 62, a valve 126 in the line 122 will be opened. However, the valve 126 may be set automatically to close upon the absence of condensate.

At this time it is pointed out that since the wash solution and the sterilizing fluid are directed through each pump unit 88, at the time the nozzles 60 are being cleansed and sterilized, the pump units are also being cleansed and sterilized.

Figure 6:
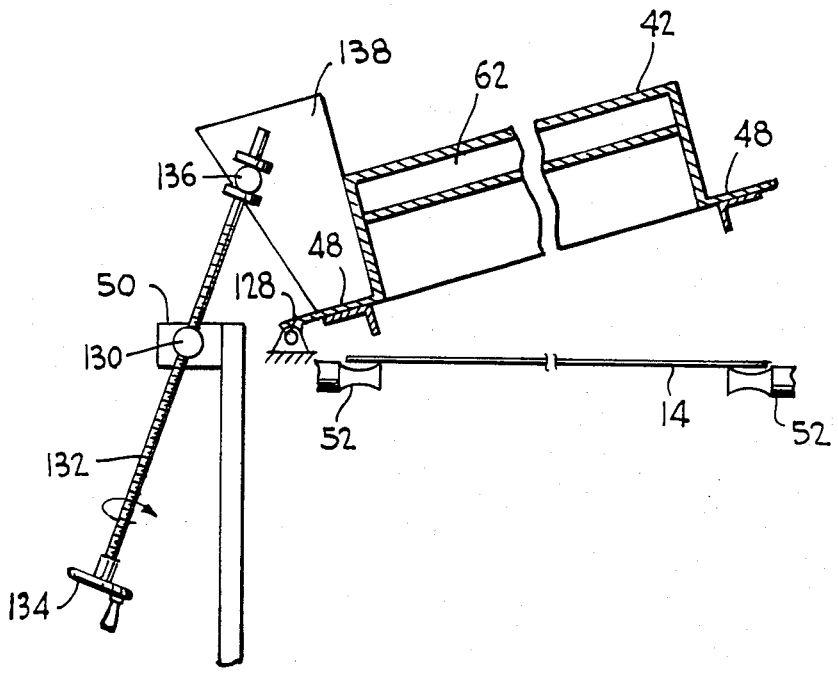
FIG. 6 is a schematic sectional view showing the manner in which that portion of the tunnel having mounted therein the filler is mounted for tilting movement during the cleaning cycle.

Reference is now made to FIG. 6 wherein the mounting of the tunnel segments 42, exclusive of the filling mechanism, is illustrated. It will be seen that the tunnel segment 42 is mounted on the frame 50 at longitudinally spaced points for pivoting about a longitudinal support shaft or shafts 128 for tilting upwardly and to one side of the machine. This tilting, which is transversely of the machine, opens up the underside portion of the filler unit 30 for inspection and necessary wiping or other cleaning as required. It also permits replacement of the sealing rings 96 and similar parts.

The tilting of the tunnel segment 42 also results in the tilting of the duct 62 carried thereby so that a minimal amount of wash solution remains within the sleeves 70 for removal.

In order to effect the controlled tilting of the tunnel segment 42, a frame member 50 which carries the pivot shaft or shafts 128 is provided with a pivotally mounted nut 130 through which an elongated threaded screw 132 having a handle 134 passes. The opposite end of the screw 132 is rotatably journalled in a connector 136 which is pivotally connected to a tunnel component 138 carried by the tunnel segment 42. Thus, by rotating the screw 132 the tunnel segment 42 may be pivoted up and down.

Referring back to FIG. 2, it will be seen that the flanges 48 carried by the tunnel segment 42 firmly seat on the frame members 50 to maintain the tunnel segment 42 in place. If desired, suitable hold-down means may be provided on the opposite side of the machine frame 50 from the pivot 128.

The specific nature of the wash solution and any type of rinse solution as well as the sterilizing fluid is not in and of itself part of this invention, and no further description will be made.

With respect to the mounting of the fillers 60 in groups of four, it is to be understood that the number of fillers mounted within the tunnel segment 42 need not be divisible by four. For example, if there should be six fillers, then there would be two shafts 112 each carrying three arms 110. The arms of the two shafts would be so arranged that plug members 104 carried by one shaft 112 would close three sleeves 70, and the plug members 104 carried by the other shaft 112 would close the remaining three sleeves 70.

Although only a preferred embodiment of the wash system has been specifically illustrated and described herein, it is to be understood that minor variations may be made in the wash system without departing from the spirit and scope of the invention as defined by the appended claims.

I claim:

1. A cleaning system for a filler of the type including a product supply line and a dispensing nozzle, said cleaning system comprising a wash solution return, said nozzle extending through said wash solution return, a sleeve surrounding said nozzle and having an open end extending beyond said nozzle, said sleeve being carried by said wash solution return in communication therewith, closure means for selectively closing said sleeve open end to form an enclosure surrounding said nozzle and in communication with said wash solution return, and means for introducing a wash solution into said sleeve through said nozzle, said closure means being in the form of a closure member, and mounting means mounting said closure member for swinging movement into and out of alignment with said sleeve and for movement axially of said sleeve for sealing engagement therewith.

2. A cleaning system according to claim 1 wherein said closure member includes a plug portion receivable in said sleeve and a sealing ring surrounding said plug portion for forming a seal with said sleeve open end.

3. A cleaning system for a filler of the type including a product supply line and a dispensing nozzle, said cleaning system comprising a wash solution return, said nozzle extending through said wash solution return, a sleeve surrounding said nozzle and having an open end extending beyond said nozzle, said sleeve being carried by said wash solution return in communication therewith, closure means for selectively closing said sleeve open and to form an enclosure surrounding said nozzle and in communication with said wash solution return, and means for introducing a wash solution into said sleeve through said nozzle, a plurality of said nozzles arranged in a cluster and spaced equidistant from a fixed center, a closure member and a sleeve for each of said plurality of nozzle, and a common support for said closure members, said common support having a rotational center coextensive with said fixed center.

4. A cleaning system according to claim 3 wherein said wash solution return is in the form of a flat duct, each of said nozzles being mounted on and extending through said duct.

5. A cleaning system according to claim 3 wherein said wash solution return is in the form of a flat duct, each of said nozzles being mounted on said duct, and said common support extending through and being rotatably journalled in said duct.

6. A cleaning system for a filler of the type including a product supply line and a dispensing nozzle, said cleaning system comprising a wash solution return, said nozzle extending through said wash solution return, a sleeve surrounding said nozzle and having an open end extending beyond said nozzle, said sleeve being carried by said wash solution return in communication therewith, closure means for selectively closing said sleeve open end to form an enclosure surrounding said nozzle and in communication with said wash solution return, and means for introducing a wash solution into said sleeve through said nozzle, first mounting means mounting said filler, said wash solution return and said closure means on a common support, and second mounting means mounting said common support for tilting about a horizontal axis to tilt said wash solution return to elevate one end thereof and thus enhance wash solution flow therethrough, and to provide access to an underpart of said filler.

7. A cleaning system according to claim 6 wherein said common support is a segment of a tunnel defining part of a sterile chamber.

8. A cleaning system for a filler of the type including a product supply line and a dispensing nozzle, said cleaning system comprising a wash solution return, said nozzle extending through said wash solution return, a sleeve surrounding said nozzle and having an open end extending beyond said nozzle, said sleeve being carried by said wash solution return in communication therewith, closure means for selectively closing said sleeve open end to form an enclosure surrounding said nozzle and in communication with said wash solution return, and means for introducing a wash solution into said sleeve through said nozzle, said wash solution return being in the form of a flat duct, said nozzle being mounted on said duct, there being a plurality of said nozzles carried by said duct, a sleeve and closure member for each of said nozzles; said duct, said fillers and said closure members all being mounted within and supported by a segment of a tunnel defining part of a sterile chamber, pivot means mounting said tunnel segment for tilting about a longitudinal axis to elevate one end of said duct to enhance wash solution flow out of said sleeves into said duct and through said duct to a wash solution collector and to provide access to said fillers.

9. A method of cleaning in a filler a product dispensing nozzle having a product supply line, said method comprising the steps of providing a sleeve surrounding the nozzle and having a free open end extending beyond the nozzle, providing a wash solution return to which the sleeve is coupled and with which the sleeve is in communication, moving closure means into position closing the sleeve open end, and when the sleeve open end is closed, introducing a wash solution through the nozzle and into said sleeve to cleanse the nozzle with the wash solution being evacuated through the wash solution return, there being provided a plurality of nozzles arranged in a cluster equidistant from a fixed center and each of the nozzles is enclosed within a sleeve, and simultaneously closing all of the sleeves.

10. A method according to claim 9 wherein the wash solution is introduced through the product supply line.

11. A cleaning system for a filler of the type including a product supply line and a dispensing nozzle, said cleaning system comprising a wash solution return, said nozzle extending through said wash solution return, a sleeve surrounding said nozzle and having an open end extending beyond said nozzle, said sleeve being carried by said wash solution return in communication therewith, closure means for selectively closing said sleeve open end to form an enclosure surrounding said nozzle and in communication with said wash solution return, and means for introducing a wash solution into said sleeve through said nozzle, a pump unit for said filler, said pump unit being coupled to said filler for supplying a predetermined quantity of a product to said filler on each actuation of said pump unit, said product supply line being coupled to said pump unit, and said means for introducing a wash solution to said nozzle including a wash solution supply line coupled to said pump unit for also washing said pump unit.

12. A cleaning system according to claim 11 together with a sterilizing fluid line also connected to said pump unit for sterilizing both said pump unit and said filler.

* * * * *